United States Patent [19]

Wallace

[11] 4,071,258

[45] Jan. 31, 1978

[54] MOBILE UNDER-BED STORAGE CONTAINER

[76] Inventor: Mabel D. Wallace, 605 Alabama St., Columbus, Miss. 39701

[21] Appl. No.: 715,205

[22] Filed: Aug. 17, 1976

[51] Int. Cl.[2] ..... B62D 53/06

[52] U.S. Cl. ..... 280/79.2; 16/29

[58] Field of Search ..... 280/79.2, 79.1 R; 217/15, 43 R, 46, 35, 56; 229/43, 41 R, 23 BT; 220/352; 16/29; 5/58

[56] References Cited

U.S. PATENT DOCUMENTS

| | | | |
|---|---|---|---|
| 985,043 | 2/1911 | Luppino | 5/58 |
| 2,756,894 | 7/1956 | Phillips | 280/79.2 |
| 3,224,789 | 12/1965 | Tessler | 280/47.26 |
| 3,242,960 | 3/1966 | Schwartzman | 229/41 R |
| 3,635,434 | 1/1972 | Chartier | 280/79.1 R |
| 3,815,808 | 6/1974 | Bunnell | 229/43 |
| 3,837,526 | 9/1974 | Medendorp | 229/43 |

*Primary Examiner*—Robert R. Song

*Attorney, Agent, or Firm*—Cushman, Darby & Cushman

[57] ABSTRACT

A mobile storage container readily disposable under the frame of a bed supported off the ground by legs. The container includes a body structure having a bottom wall, side walls, and an open top, a cover of flexible material for the open top and for fitting and extending over the side walls, and caster assemblies for supporting the body for rolling movement. Hand-hold cutouts provided in the side walls of the body, and corresponding openings in the cover, provide ventilation of the container interior, and for ready grasping thereof for movement under and from beneath a bed. The height of the container from the bottom of the caster assemblies to the top of the side walls is less than the height of the bed frame supported off the ground by legs. The caster assemblies are recessed to provide maximum storage volume and maximum mobility for a minimum container height, and the cover is transparent so that the container contents may be viewed without removal thereof.

8 Claims, 4 Drawing Figures

Fig. 1.
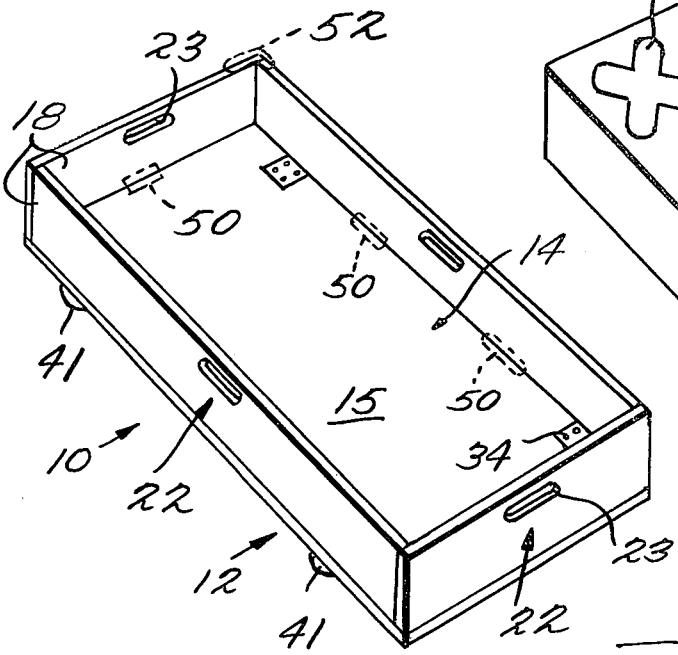
Fig. 2.
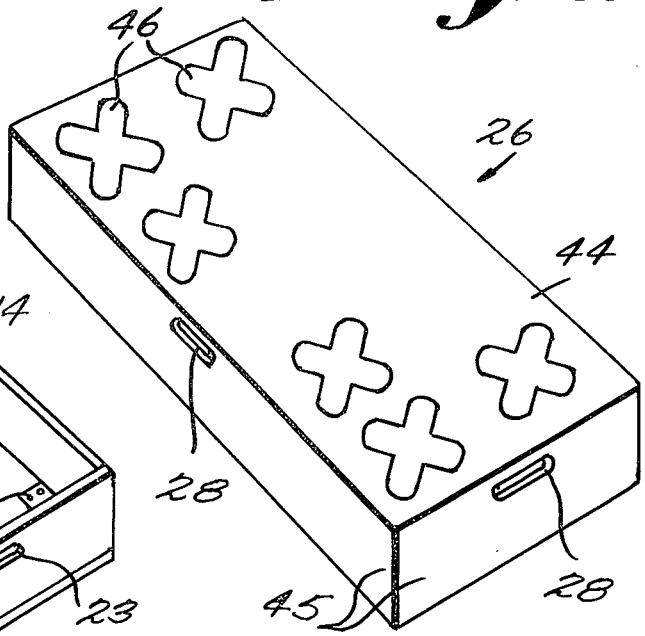
Fig. 3.
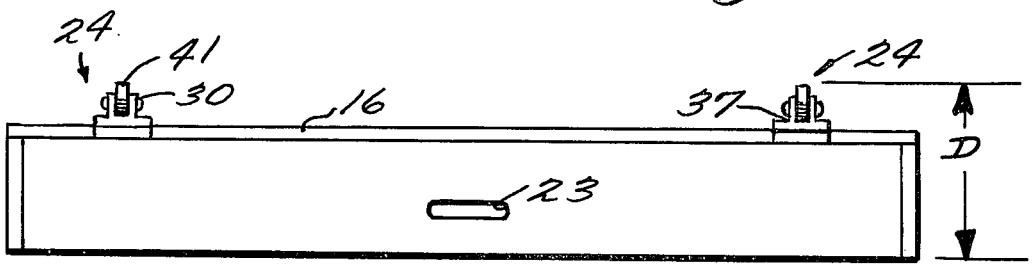
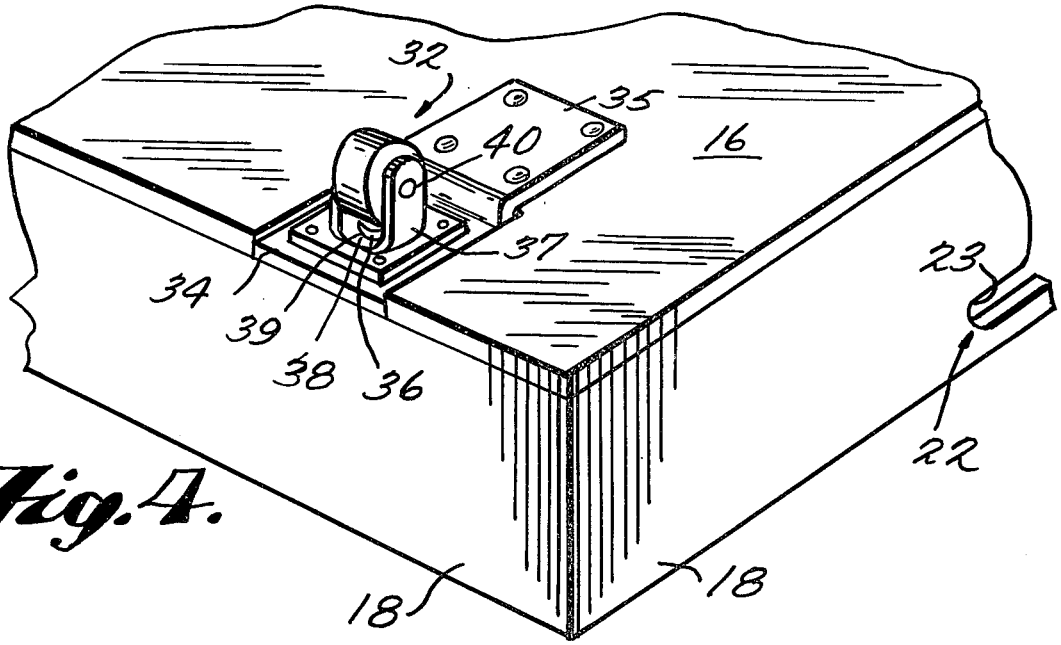
Fig. 4.

MOBILE UNDER-BED STORAGE CONTAINER

BACKGROUND AND SUMMARY OF THE INVENTION

The invention relates to a structure for utilizing otherwise wasted space as a convenient storage area for shoes, sheets, articles of clothing, or the like. Presently, the area underneath a conventional bed frame supported off the ground by legs is wasted. According to the present invention, articles may be stored underneath a bed yet they remain dust-free (though ventilated), and they are readily accessible, being easily moved underneath or out from underneath the bed by grasping and rolling thereof.

According to the present invention, a storage container is provided comprising a box-like body structure having a bottom wall (with upper and lower surfaces), a plurality of side walls, an open top, a cover for the open top, means for ventilating and providing grasping thereof, and a plurality of caster assemblies supporting the body for rolling movement, the height of the container from the bottom of the caster assemblies to the top of the side walls being less than the height of a conventional bed frame supported off the ground by legs. The cover for the open top of the body is made of flexible material, and fits and extends over the side walls of the body, and has openings formed therein corresponding to cutouts formed in the side walls of the body which provide for ventilation of the storage volume as well as ready grasping of the container for rolling movement thereof. The cover is of transparent material so that the contents of the container may be readily viewed without removing the cover, or at least a portion of the top of the cover is transparent.

The caster assemblies are recessed with respect to the bottom wall of the body, and positioned inwardly with respect to the sides of the body, so that maximum storage volume and maximum mobility may be provided for the container while it still fits underneath a bed. The caster wheels are also mounted so that they are rotatable about both vertical and horizontal axes so that when one grasps a hand-hold of the container, it may be readily pushed or pulled in any direction to effect rolling movement thereof.

It is the primary object of the present invention to provide a mobile storage container for dust-free ventilated storage of articles that is readily disposable under the frame of a bed supported off the ground by legs so that area that normally would be wasted may be utilized for effective accessible storage of articles. This and other objects of the invention will become clear from an inspection of the detailed description of the invention, and from the appended claims.

BRIEF DESCRIPTION OF THE DRAWINGS

FIG. 1 is a perspective view of an exemplary body of a storage container according to the present invention;

FIG. 2 is a perspective view of an exemplary cover of flexible material adapted to be disposed over the body of FIG. 1;

FIG. 3 is a side, schematic upside-down view of the container of FIG. 1; and FIG. 4 is a perspective detail view of corner of the upside-down container of FIG. 3 only with recessed castors.

DETAILED DESCRIPTION OF THE INVENTION

In the drawings, the following reference numerals refer to the following elements respectively:

| | |
|---|---|
| 10 container | 12 body structure |
| 14 bottom wall | 15 bottom wall upper surface |
| 16 bottom wall lower surface | 18 side walls |
| 20 open top | 22 ventilating, grasping means |
| 23 hand-hold cutouts in side walls | 24 caster assemblies |
| 26 flexible cover | 28 means defining cover openings |
| 30 caster mounting means | 32 metal plate member |
| 34 first portion of metal plate member | 35 second, displaced portion of plate |
| 36 vertical pivot pin | 37 wheel support structure |
| 38 opening in wheel support structure | 39 Projection on pivot pin |
| 40 horizontal pivot pin | 41 wheel |
| 44 flexible cover top | 45 flexible cover sides |
| 46 transparent portion of cover | 50 side wall pivots |
| 52 side wall latches | |

A mobile storage container that is readily disposable under the frame of a bed supported off the ground by legs is shown generally at 10 in the drawings. The container 10 comprises a box-like body structure 12 having a bottom wall 14 (with upper and lower surfaces 15, 16, thereof respectively) and a plurality of side walls 18 and an open top, the upper surface 15 of the bottom wall 14 adapted to support shoes, sheets, or like articles to be stored thereon. Means for ventilating the body structure 12 and for providing grasping thereof for ready movement thereof are shown generally at 22, said means defining at least one hand-hold cutout 23 in a side wall 18. A plurality of caster assemblies 24 extend downwardly from the lower surface 16 of the bottom wall 14 and provide support of said body structure 14 for rolling movement thereof. A cover 26 of flexible material for said body structure 14 covers the open top 20 thereof and fits and extends over the side walls 18 of the body 14, means 28 defining at least one hand-hold opening in the flexible cover 26 corresponding to the at least one hand-hold cutout 23 in a side wall 18 of the body 12. The height D of the container 10 from the bottom of the caster assembly 24 to the top of the side walls 18 — as shown in FIG. 3 — is less than the height of the frame of a bed supported off the ground by legs so that the container 10 may readily be disposed under a bed to provide clean, ventilated storage of articles without taking up floor space that is otherwise utilizable for other purposes. Also, the width and length of bottom wall 14 are dimensioned so that the container will fit under any size bed desired, or so that 3 containers may fit under a normal full size bed (i.e., the container bottom wall is 23 inches × 48 inches).

The body structure 12 may be constructed of plywood, plastic, or other suitable material. When formed of plywood, it is especially easy to recess the caster assemblies 24 in the bottom wall 14, recessed casters being desirable so that the height D of the container 10 can be kept to a minimum while still providing maximum storage volume in the container 10 and proper mobility thereof. Preferably, the height D is 6 ½ inches or less so that the container 10 may be disposed underneath all conventional beds having frames supported off the ground by legs. The hand-hold cutouts 23 — preferably one is formed in each of the side walls 18 — in addition to providing necessary ventilation of the container volume also allow ready grasping of any side 18 of the container 10 by an individual so that the container may be placed under or removed from beneath a bed frame by pushing and pulling on the container and thereby rolling it along the floor.

The means 30 for recess-mounting of the caster assemblies 24 with respect to the bottom wall 14, and inwardly of the side walls 18, each preferably comprises a metal plate member 32 having one portion 34 thereof substantially flush with the upper surface 15 of the bottom wall 14, as is shown most clearly in FIGS. 1 and 4. Another portion 35 of plate member 32 is vertically and longitudinally displaced with respect to the first portion 34, the second portion 35 being mounted on the lower surface 16 of the bottom wall 14. The amount the second portion 35 is vertically displaced with respect to the first portion 34 is substantially equal to the thickness of the bottom wall 14. It is to be understood, however, that a greater or lesser degree of vertical displacement of the first and second portions of plate member 32 may be provided depending upon the amount of recessing that is desired, or other suitable recess-mounting means may be employed.

Means are also provided for mounting the caster assemblies 24 so that wheels 41 thereof may rotate both about horizontal and vertical axes with respect to the body 12, said means including a vertical pivot pin 36, a wheel support structure 37, an opening 38 in the wheel support structure 37, a projection 39 on the pivot pin 36, and a horizontal pivot pin 40 for each wheel 41. The metal plate member 32 has the vertical pivot pin 36 extending outwardly therefrom, the pin 36 passing through the opening 38 in the wheel support structure 37, and a projection 39 formed on the pin 36 preventing passage of the end of the pin 36 through the opening 38 once it is disposed therein, while still allowing relative rotation of the support structure with respect to the pivot pin. The support structure 37 also mounts the horizontal pivot pin 40 about which the wheel 41 rotates. Thus, the container 10 may be rolled in any direction merely by grasping a hand-hold cutout 23 and pulling or pushing on the respective container side wall 18.

The flexible material cover 26, which is shown in FIG. 2 removed from the body 12, has a top 44 thereof for covering the open top 20 of the body 12, and has sides 45 for fitting and extending over the side walls 18 of the body 12, the sides 45 having the means 28 defining the ventilating openings therein corresponding to the cutouts 23. Preferably, the cover 26 is made of transparent material, such as clear plastic, or at least has transparent portions 46 formed in the top 44 thereof. In this way, one need not remove the cover to view the articles disposed therein, and the interior volume of the container is maintained dust-free, which is important since a relative amount of dust usually is present underneath a bed frame.

If desired, for ease of transport of the container 10, or for ease of storage thereof in an upright position or the like, the side walls 18 may be pivoted, as shown in dotted line at 50 in FIG. 1, so that they are collapsible with respect to the bottom wall 14. Side wall latches 52 (shown in dotted line in FIG. 1) may then be provided to latch the side walls 18 in their normal upright, storage-volume defining position.

It will thus be seen that according to the present invention a storage container has been disclosed that provides for ready, dust-free, ventilated storage of shoes, sheets, articles of clothing, or the like underneath a conventional bed having a frame supported by legs, so that space that might otherwise be wasted may be utilized. The container is readily movable under and from beneath the bed, and provides maximum storage volume and maximum mobility for a given overall height thereof. While the invention has been herein shown and described in what is presently conceived to be the most practical and preferred embodiment of the invention, it will be apparent to one of ordinary skill in the art that many modifications may be made thereof within the scope of the invention, which scope is to be accorded the broadest interpretation of the appended claims so as to encompass all equivalent structures and devices.

What is claimed is:

1. A mobile storage container readily disposable under the frame of a bed supported off the ground by legs, said container comprising:

a box-like body structure having a bottom wall with upper and lower surfaces, a plurality of side walls, and an open top, the upper surface of said bottom wall adapted to support articles to be stored thereon; means for ventilating said body structure and for providing grasping thereof, said means including means defining at least one hand-hold cutout in a side wall; a plurality of caster assemblies having wheels extending downwardly from the lower surface of said bottom wall for supporting said body structure for rolling movement; means for mounting each of said caster assemblies in a recessed position with respect to said body bottom wall, and inwardly of the side walls of said body, including a metal plate member having one portion thereof substantially flush with the upper surface of said bottom wall, and having another vertically and longitudinally displaced portion thereof mounted on the lower surface of said body bottom wall; a flexible material cover for said body structure to cover the open top thereof and to fit and extend over said side walls of said body structure; means defining at least one opening in said flexible cover corresponding to the hand-hold cutout in said at least one side wall of said body structure; and the height D of the container from the bottom of said caster assemblies to the top of said side walls being less than the height of the bed frame supported off the ground by legs.

2. A container as recited in claim 1 wherein D is less than or equal to 6 ½inches.

3. A container as recited in claim 1 wherein said body is made of plywood.

4. A container as recited in claim 1 wherein one hand-hold cutout is provided in each side wall of said body, and wherein one opening is provided in said flexible material cover corresponding to each of said side-wall hand-hold cutouts.

5. A container as recited in claim 1 wherein said side walls are collapsible with respect to said bottom wall for ease of transport of said container.

6. A container as recited in claim 1 wherein said flexible material of said cover has at least one top portion thereof that is transparent.

7. A mobile storage container readily disposable under the frame of a bed supported off the ground by legs, said container comprising; a box-like body structure having a bottom wall with upper and lower surfaces, a plurality of side walls, and an open top, the upper surface of said bottom wall adapted to support articles to be stored thereon; means for ventilating said body structure and for providing grasping thereof, said means including means defining at least one hand-hold cutout in a side wall; a plurality of caster assemblies having wheels extending downwardly from the lower surface of said bottom wall for supporting said body structure for rolling movement; means for mounting said caster assemblies so that the wheels thereof may rotate both about horizontal and vertical axis with respect to said body, said means for mounting each of said caster assemblies for rotary movement about a vertical axis including a metal mounting plate having one portion thereof substantially flush with the upper surface of said bottom wall and having another vertically and longitudinally displaced portion thereof attached to the lower surface of said bottom wall and a pivot pin extending outwardly from said one portion of said metal mounting plate and passing through an opening in a caster support structure, said pivot pin having an end thereof remote from said metal supporting plate with a projection that prevents the passage of the end thereof through said support structure opening while still allowing relative rotation of said support structure with respect to said pivot pin; a flexible material cover for said body structure to cover the open top thereof and to fit and extend over said side walls of said body structure; means for defining at least one opening in said flexible cover corresponding to the hand-hold cutout in said at least one side wall of said body structure; and the height D of the container from the bottom of said caster assemblies to the top of said side walls being less than the height of the bed frame supported off the ground by legs.

8. A container as recited in claim 7 wherein said side walls are collapsible with respect to said bottom wall for ease of transport of said container.

* * * * *